US008904683B2

(12) United States Patent
Tornqvist et al.

(10) Patent No.: US 8,904,683 B2
(45) Date of Patent: Dec. 9, 2014

(54) DEVICE AND METHOD FOR CHANGING ELONGATED OBJECTS

(75) Inventors: Christopher Tornqvist, Lidingo (SE); Peter Tornqvist, Lidingo (SE)

(73) Assignee: Christopher Tornqvist, Lidingo (SE)

( * ) Notice: Subject to any disclaimer, the term of this patent is extended or adjusted under 35 U.S.C. 154(b) by 7 days.

(21) Appl. No.: 13/805,518

(22) PCT Filed: Jun. 28, 2011

(86) PCT No.: PCT/SE2011/000124

§ 371 (c)(1),
(2), (4) Date: Dec. 19, 2012

(87) PCT Pub. No.: WO2012/002872

PCT Pub. Date: Jan. 5, 2012

(65) Prior Publication Data

US 2013/0086832 A1 Apr. 11, 2013

(30) Foreign Application Priority Data

Jun. 29, 2010 (SE) ..... 1000695

(51) Int. Cl.

| | |
|---|---|
| ***G09F 11/10*** | (2006.01) |
| ***G09F 11/08*** | (2006.01) |
| ***E06B 9/40*** | (2006.01) |
| ***G09F 11/30*** | (2006.01) |

(52) U.S. Cl.

CPC . *G09F 11/08* (2013.01); *E06B 9/40* (2013.01); *G09F 11/10* (2013.01); *G09F 11/30* (2013.01)

USPC ..... 40/498; 40/500; 40/507

(58) Field of Classification Search

CPC ..... G09F 11/02; G09F 11/025; G09F 11/04; G09F 11/06; G09F 11/08; G09F 11/10

USPC ..... 40/493, 496, 497, 498, 499, 500, 501, 40/506, 507, 516

See application file for complete search history.

(56) References Cited

U.S. PATENT DOCUMENTS

| | | | | |
|---|---|---|---|---|
| 375,987 | A | 1/1888 | Castel | |
| 1,234,415 | A * | 7/1917 | Swanson | 40/499 |
| 2,775,354 | A * | 12/1956 | Staats | 414/157 |
| 3,771,242 | A * | 11/1973 | Lagasse et al. | 40/475 |
| 4,658,524 | A * | 4/1987 | Jackson et al. | 40/499 |
| 2009/0158627 | A1 | 6/2009 | Lee | |

FOREIGN PATENT DOCUMENTS

| | | | |
|---|---|---|---|
| EP | 0 751 278 | A1 | 1/1997 |
| JP | 2003/096725 | A | 4/2003 |
| WO | 9732294 | A1 | 9/1997 |

OTHER PUBLICATIONS

International Search Report, dated Oct. 13, 2011, from corresponding PCT application.

* cited by examiner

*Primary Examiner* — Stephen M Johnson
(74) *Attorney, Agent, or Firm* — Young & Thompson

(57) ABSTRACT

A device for successively changing elongated flexible objects from an active viewable position to a non-active, non-viewable position includes a rotatable drum to which the flexible objects are attached, a motor driving the rotatable drum in opposing rotational directions, and a controller unit controlling motor speed and direction. A balancing spring is preloaded when the flexible objects are unwound from the drum, providing a lifting force when the flexible objects are wound up on the drum. By using a freewheeling clutch, preloading only occurs in one rotational direction, the balancing spring freewheeling in the other direction, taking no load. Utilizing a magnetically interactive identification strip the device gains highly accurate information on the position of the flexible elongated objects. By pre-attaching the flexible elongated objects on each other and providing the identification strip on the designated carrier flexible object exchanging the set of flexible elongated objects is made very simple.

16 Claims, 10 Drawing Sheets

DEVICE AND METHOD FOR CHANGING ELONGATED OBJECTS

TECHNICAL FIELD

The present invention relates to a device and a method for successively changing elongated sheets or similar flexible objects from an active viewable position to a non-active, non-viewable position, said device comprising a rotatable drum to which the flexible objects are attached, a motor arranged for driving the rotatable drum in two opposing rotational directions, and a controller unit for controlling the rotational speed and direction of the motor.

BACKGROUND ART

In the commercial world of today more and more advertising is made. Stores are using advertisement posters to communicate their messages to the public. However, space is sometimes a limiting factor when it comes to exposing posters. To solve this problem it is known to use devices, which are capable of changing posters, by for instance rotating an "endless" belt or band consisting of many individual posters through a cylinder arrangement. In this fashion one surface may be used to display several different messages or advertisements.

However many of the known devices are usually complicated to handle, because of their complex design. For instance it might take a long time and be complicated to change a set of posters for new ones. The complexity with many different parts also contributes to the high cost for such devices.

One improved device is described in EP 883 875. This device comprises a drum on which different posters can be wound up and unwound. The posters are attached to the drum with the same distance therein between and by rotating the drum in a certain way and in different directions it is possible to show one poster at a time. A mechanical circuit controls the timing of the drums rotation, even if it is mentioned that it would be possible to use an electrical circuit. However, it is not further described how the electrical circuit could be realised. The mechanical circuit is complex and consists of a lot of different parts. One other aspect of the mechanical circuit is that it is noisy and different timing aspects have to be set in a mechanical way, which make it limited when it comes to set different time intervals.

A drawback with the device according to EP 883 875 is that it requires a strong motor when the posters or any other flexible objects become large and thereby heavy. Thus, it is important with a sufficient power supply. A large motor is of course also noisier than a small one.

SUMMARY OF THE INVENTION

One object of the present invention is to provide a device for changing elongated flexible objects, which is much more energy efficient, silent, user friendly and reliable than today's devices.

The above object is according to the present invention solved by that the drum of the device comprises a balancing spring that is arranged to be preloaded during the unwinding of the flexible objects and providing a lifting force when the flexible objects are wound up whilst still allowing the device to retain the functionality of previous devices.

The present invention also describes a method for user-friendly attachment of the flexible objects as well as a method for self-calibration.

BRIEF DESCRIPTION OF THE DRAWINGS

The present invention will now be described in more detail in relation to the enclosed drawings, in which.

DETAILED DESCRIPTION OF THE PREFERRED EMBODIMENTS

Figure 1:
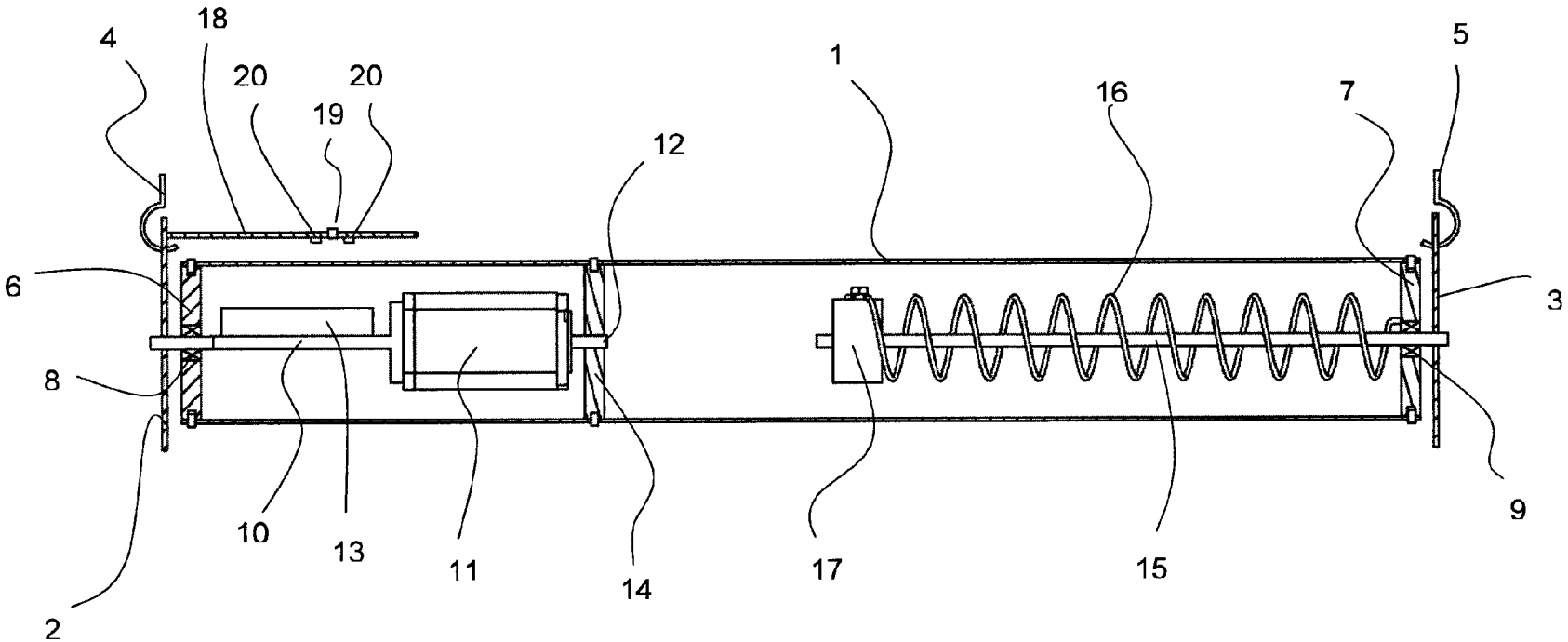
FIG. 1 schematically shows the device for changing elongated flexible objects, partly in cross section.

The embodiment of the present invention will now be described. First of all the parts comprising the device will be described as depicted in the partly cross sectional view of FIG. 1.

The device comprises a drum 1 with rotational freedom between two end holding means 2, 3, preferably in the shape of discs. At each end the drum 1 is fitted with end covers 6 and 7 respectively. From a first end holding means 2 a motor holding bar 10 protrudes through the end cover 6. A motor 11 for rotating the drum 1 of the device is provided inside the drum 1 and is held in place by the motor holding bar 10. A controller unit 13 for controlling the speed and direction of the motor 11 as well as other aspects of the operation of the device is mounted on the motor holding bar 10. The motor 11 exerts its torque to the drum 1 via a driving disc 14. An output shaft 12 from the motor 11 is connected to the driving disc 14 in such a way that when the shaft 12 rotates the driving disc 14 also rotates. At the opposite end of the drum 1 a journal 15 protrudes from a second end holding means 3 through the end cover 7. The journal 15 is rigidly connected to the second end holding means 3. A freewheeling clutch 17 is provided towards the end of the journal 15. A balancing spring 16 is connected to the end cover 7 at one end and to the freewheeling clutch 17 at the other end.

The motor holding bar 10 and the first end holding means 2 are fixed connected and may be produced as a single part, e.g. welded. The same applies to the second end holding means 3, which may be combined with the journal 15 into a single part. In order to minimize friction as the drum 1 rotates bearings 8 and 9 are housed in the end covers 6 and 7. The end holding means 2 and 3 must not be allowed to rotate more than a small distance with reference to each other and may therefore be directly locked to each other or even produced as a single part.

Protruding from the first end holding means 2 is a girder 18 containing a magnet 19 and identifying means 20.

Figure 2:
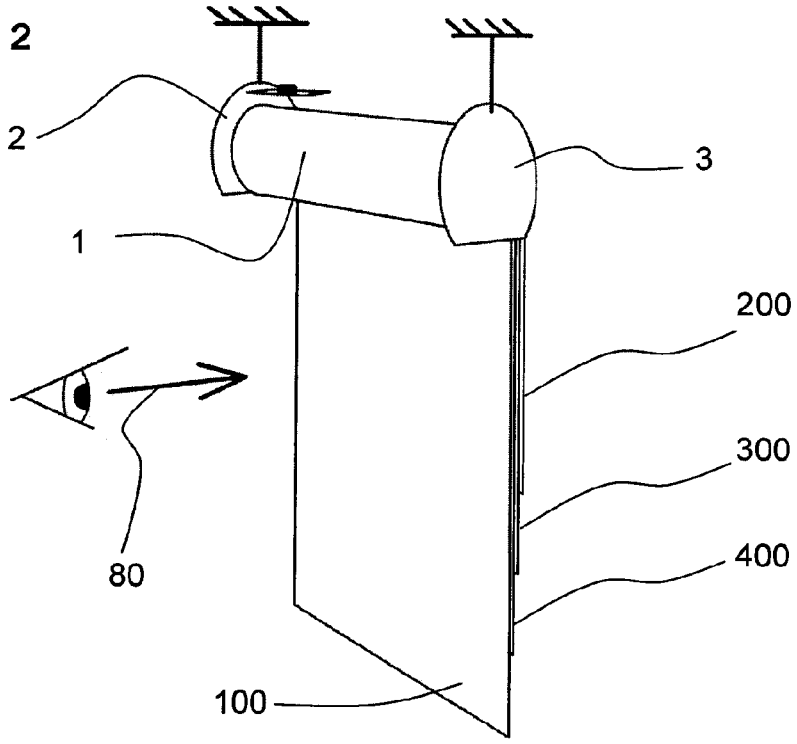
FIG. 2 shows the device according to FIG. 1, having posters attached to it. The arrow indicates the preferred direction of a spectator.
Figure 3:
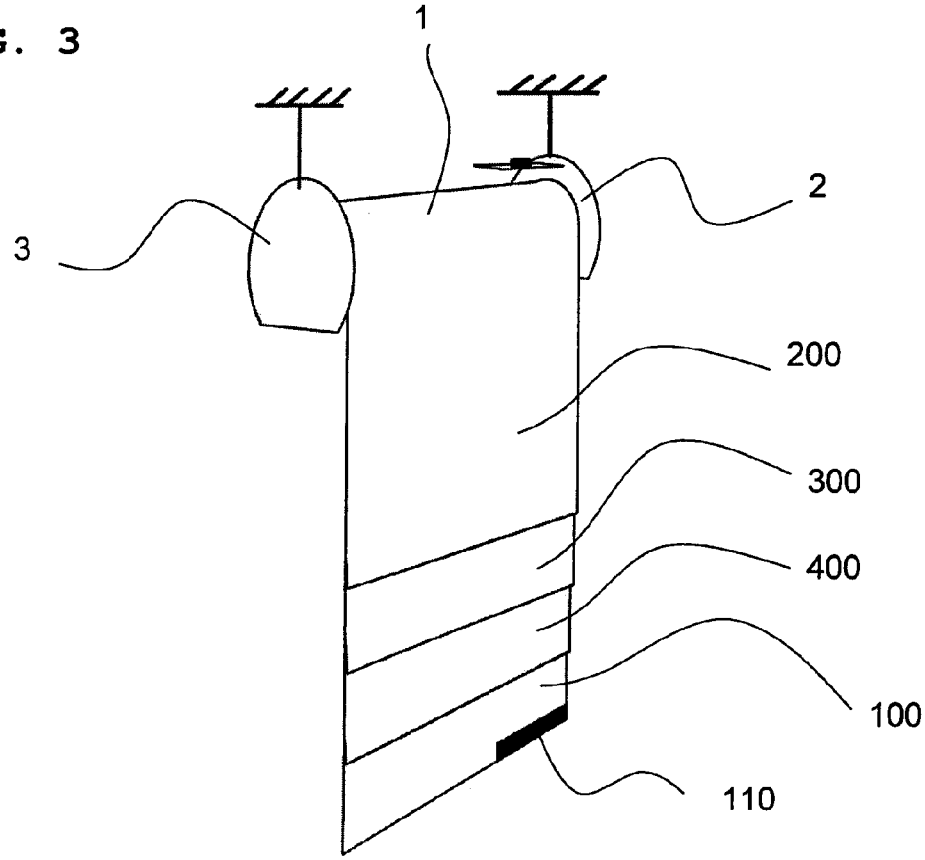
FIG. 3 shows the device according to FIG. 1 and FIG. 2, but looking at the preferred back side of the posters.

Suspension means 4 and 5, e.g. in the shape of hooks, may be added to the device in order to facilitate installation from ceiling, wall or a particular stand. The suspension means 4 and 5 engage the holding means 2 and 3. In order to use the device for its main purpose, flexible elongated objects 100-400, referred to as posters, are attached to the drum 1, as depicted in FIGS. 2 and 3. Expecting that the posters 100-400 are fully wound out, one of them will be exposed to a viewer in front of the device. Arrow 80 in FIG. 2 indicates this viewable direction. In order to provide a means for the controller unit 13 to calibrate the position of the posters or derive other necessary information about the system, an identifiable magnetically attractable object 110, referred to as identification strip, is attached to at least one of the posters, e.g. the poster 100 as depicted in FIGS. 3,5,6,7,8 and 10. The identification strip 110 may however be integrated into the very fabric of the poster 100, e.g. by use of special thread or printing ink.

The principle of operation will be described below.

In order to describe the new functionality introduced by the present invention it is necessary to summarize the main function of changing and displaying posters. This function is in itself not unique to the present invention and can be found in the existing invention, EP 883 875. However the additional new functionality added by the present invention is clearly described below.

Figure 5:
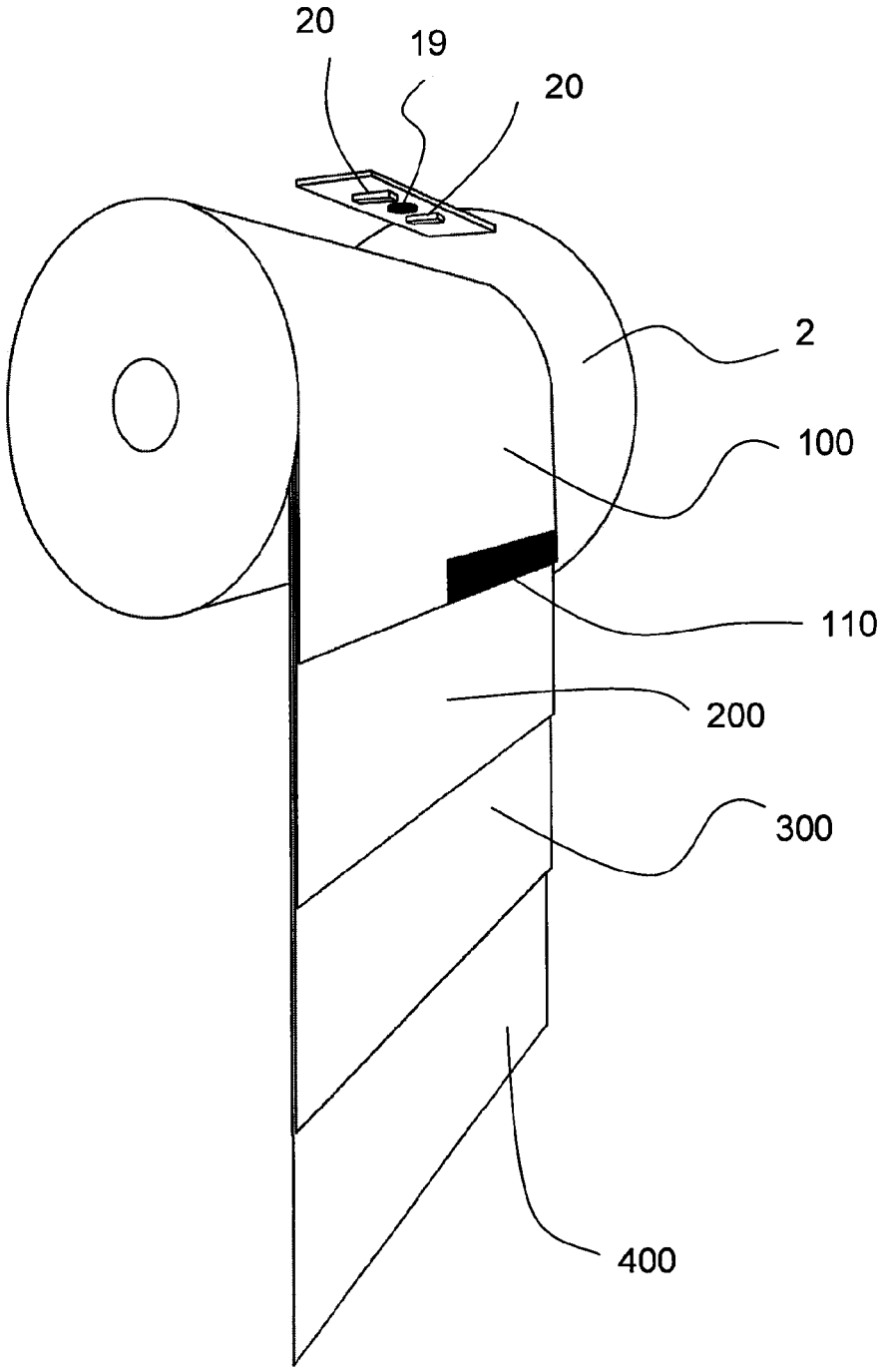
FIGS. 5 to 10 depict in sequence the process by which the device changes the exposed poster.
Figure 6:
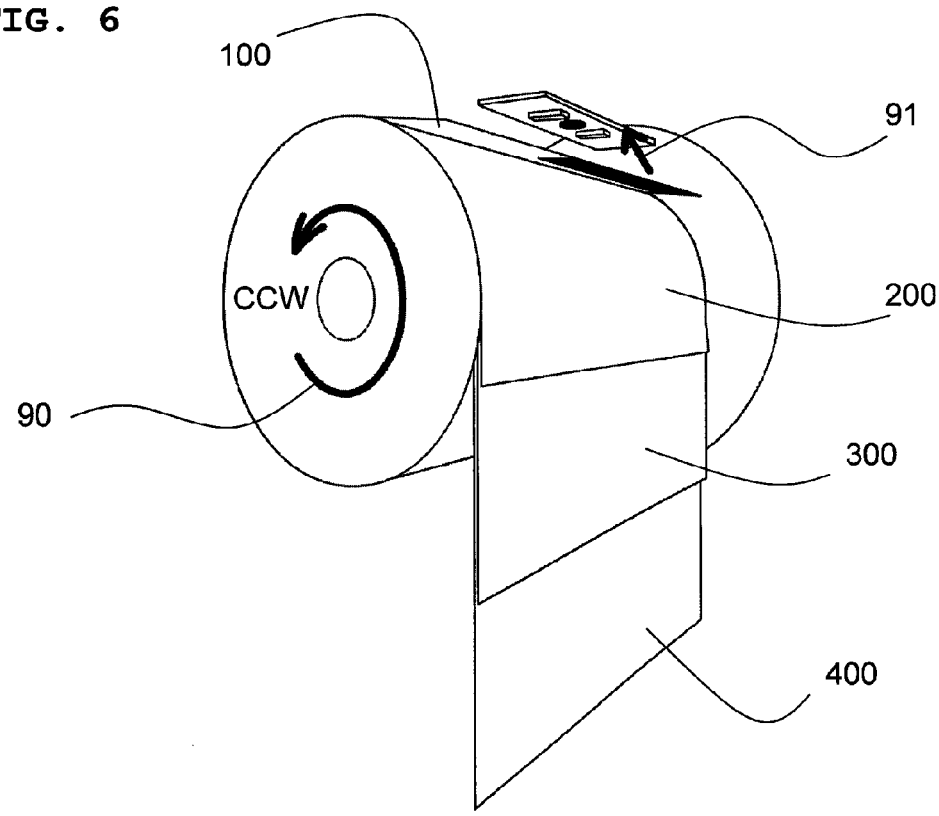
Figure 7:
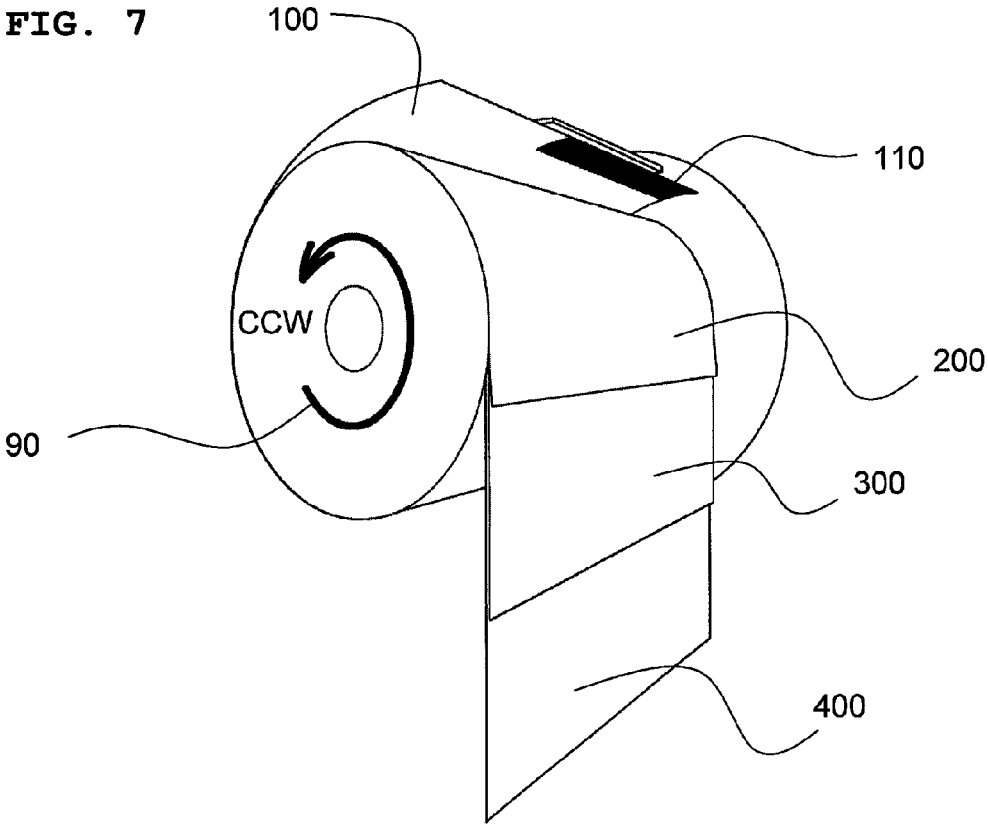

According to FIG. 5 poster 400 is in an exposed state. The device is depicted with 4 posters, but the device can easily be used with other numbers of posters attached to the drum 1. In order to display another poster the device will start to turn the drum 1 counterclockwise around its axis according to the arrow 90 in FIG. 6 thus winding up the attached posters 100-400. Eventually, as the objects are fully wound up, the one object that was furthest back when starting to wind up, in this case poster 100, will fall over the top as depicted by arrow 94 in FIG. 9 and thereby become the front object. As this happens the device reverses the rotation of the drum 1, winding the posters 100-400 down clockwise which is indicated by the arrow 95 seen in FIG. 10. This motion continues until the newly exposed poster 100 is fully exposed. The device then stops, exposing the object for an arbitrarily set amount of time after which the cycle repeats for the next poster to be shown and so on. The device can however be interrupted at any time, during any part of the cycle, without affecting the function of the device as long as this does not cause any loss of information regarding the exact position of the posters. For instance it may be preferred to halt the device as the newly exposed poster falls over the top of the drum 1 or pause the unwinding midways. This can be achieved either by direct input from the user or as part of a pre-programmed procedure, but it is outside the scope of this text to describe this any further as it is easily realized by a person skilled in the art.

It should be noted that even though the motion consists of both clockwise and counterclockwise rotation the total sum of all rotation has to be counterclockwise with reference to FIGS. 5 to 10. In order to successively change the posters the drum 1 is turned a certain amount more counterclockwise than clockwise for every object. For a set of two posters that amount is ½ of a revolution, for a set of three it is ⅓ of a revolution and so on. A prerequisite for this is that the elongated flexible objects 200-400 are attached to the carrier flexible object 100 at distances of ½ the drum circumference for a number of two posters, ⅓ the drum circumference for a number of three posters, ¼ for a number of four posters and so on.

Below the function of the balancing spring assembly is described in detail. In order to wind up the posters 100-400 it is necessary that the motor 11 driving the system produces a lifting force to overcome the weight of the poster 100-400. By introducing a spring 16 that is connected to the drum 1, via the end cover 7, at one end and to the journal 15, via the freewheeling clutch 17, at the other end it is possible to preload the device in such a way that the force of the spring 16 balances the weight of the posters 100-400 to a high degree. The spring 16 is therefore referred to as a balancing spring. When the posters 100-400 are completely wound up the balancing spring 16 is not loaded at all, i.e. has no inherent load. As the posters 100-400 are wound down the balancing spring 16 is spun and thereby continuously gets preloaded enough to balance the weight of the posters 100-400. Similarly as the posters 100-400 are wound up the balancing spring 16 continues to provide this lifting force.

This means that instead of having to lift the entire weight of the objects the motor only has to provide enough force for acceleration. Thereby the physical requirements of the motor are reduced significantly, indirectly reducing noise and power consumption as well.

Figure 4:
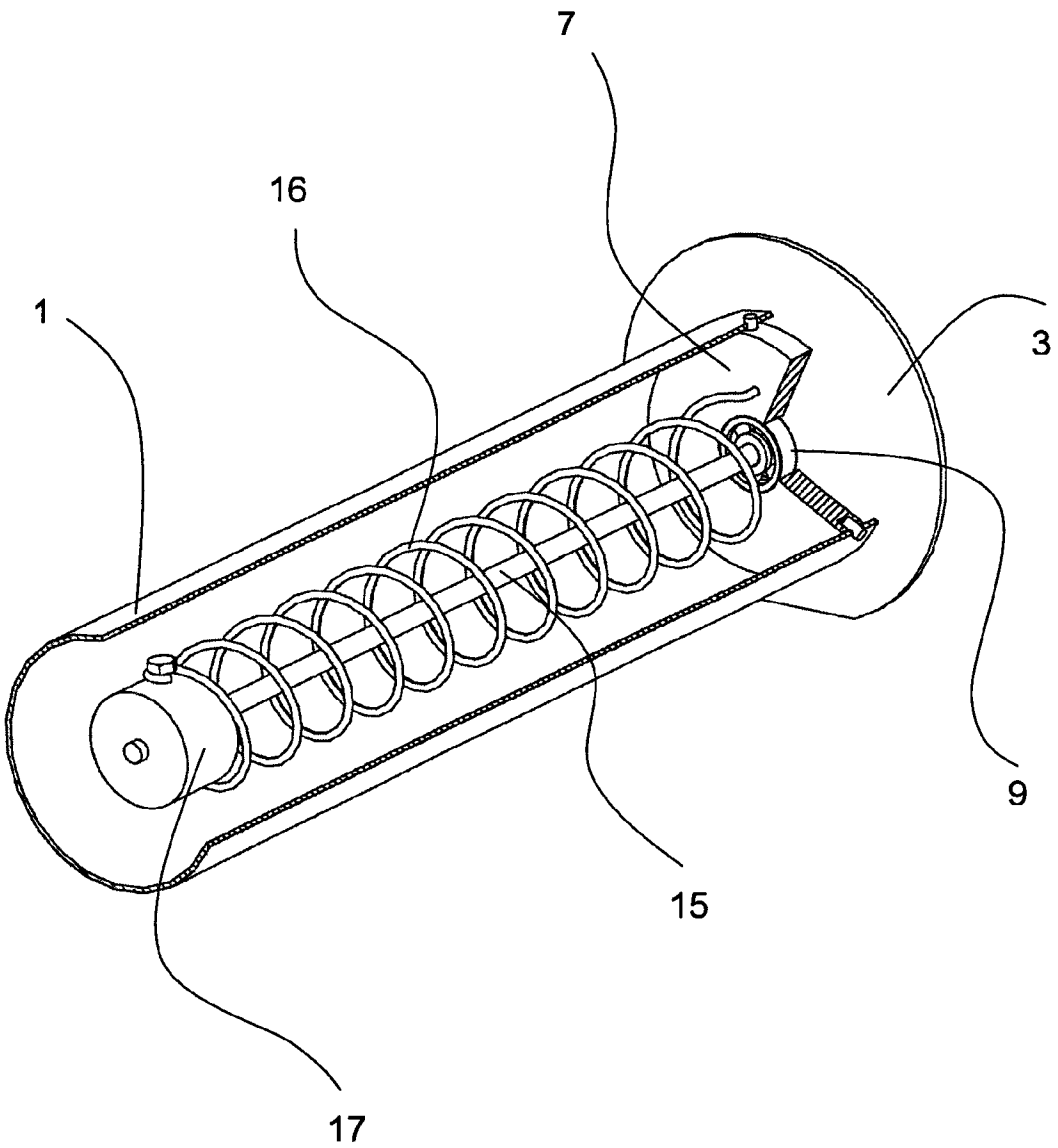
FIG. 4 shows a perspective view of the freewheeling balancing spring assembly. One end of the balancing spring 16 is fixed to the end cover 7. The other end of the balancing spring 16 is connected to the journal 15 via a freewheeling clutch 17.

The balancing spring 16 is fixed connected to the drum 1 via end cover 7. At the start of winding down a poster the balancing spring 16 is supposed to provide no lifting force. This also has to comply with the inherent function of the device to successively rotate the drum 1 slightly more counterclockwise than clockwise for every poster changed. Therefore the balancing spring 16 is connected via a freewheeling clutch 17 to the journal 15. This allows the balancing spring, end cover, drum-package to freewheel counterclockwise without preloading the balancing spring 16 whereas clockwise rotation is clutched meaning that the balancing spring 16 is preloaded. In this way the device is allowed continuous counterclockwise motion whilst still benefiting from having the weight of the posters 100-400 balanced. In FIG. 4 the balancing spring 16 is depicted as a torsion spring as this is the preferred embodiment, but it should be realized that other types of springs may be used to achieve the objective of balancing the weight of the posters.

Figure 4A:
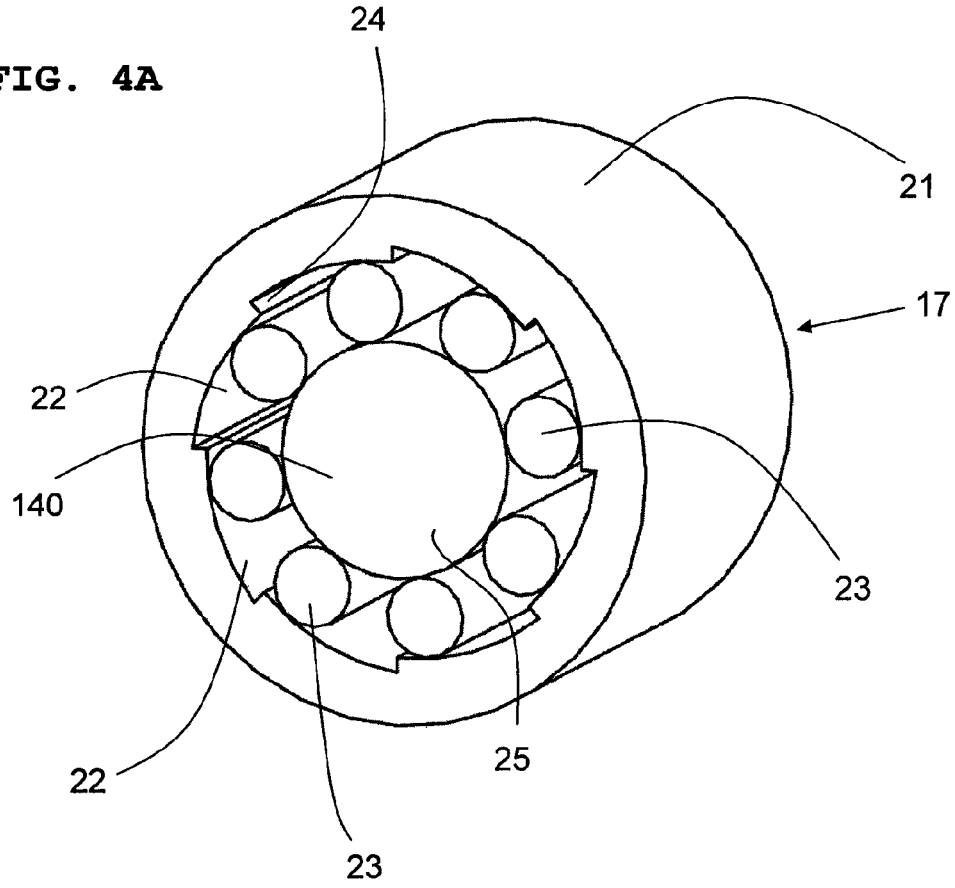
FIG. 4A shows a perspective view of the structural design of the freewheeling clutch 17.
Figure 4B:
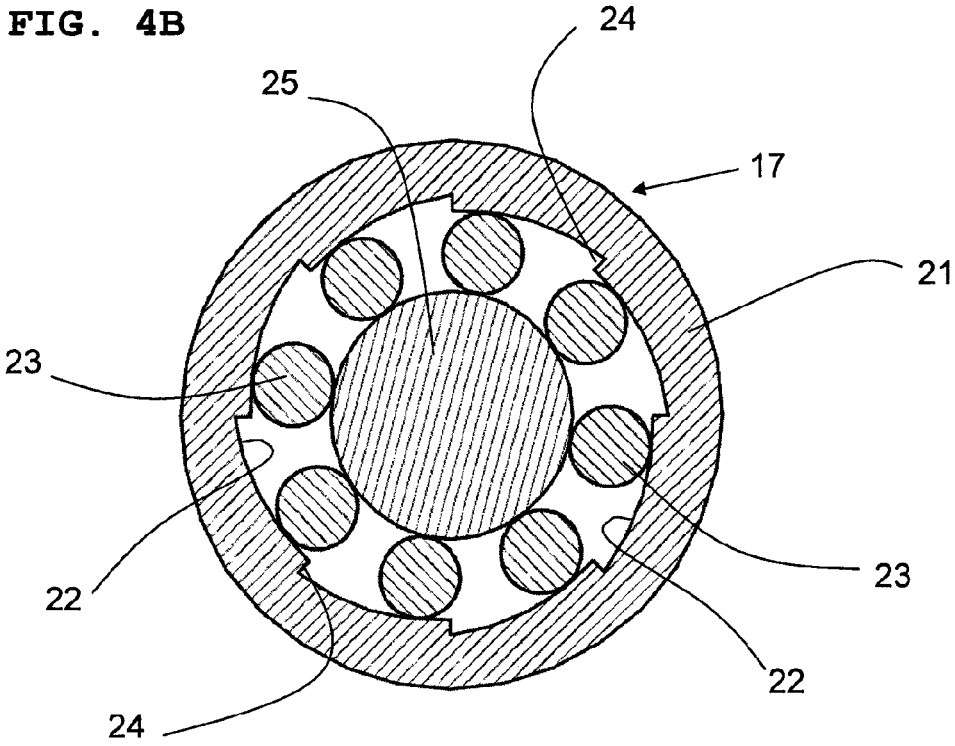
FIG. 4B shows a cross section of the structural design of the freewheeling clutch 17.

In FIGS. 4A and 4B the structural design of the freewheeling clutch 17 is shown schematically. The freewheeling clutch 17 thus constitutes of a so called one way needle clutch. The outer ring 21 is provided with a number of segments 22 on its inner side, said segments 22 defining rolling surfaces for a number of rollers/needles 23 that are included in the one way needle clutch 17. The segments 22 have a varying distance in relation to the center of the one way needle clutch 17 in the circumferential direction of the outer ring 21. Therefore, adjacent segments 22 are connected by radial steps 24. By studying FIG. 4B it is realized that when the outer ring 21 is rotated in counter clockwise direction/CCW the rollers 23 abut the steps 24 and the rotation is permitted. If the outer ring 21 is rotated in a direction opposite to CCW the rollers 23 will be jammed between the outer ring 21 and a central cylindrical body 25 of the one way needle clutch 17. Thus rotation is prohibited.

If the balancing spring 16 was directly fixed to both the journal 15 and drum 1, i.e. no freewheeling clutch was present, it would in order to comply with the incremental counterclockwise rotation be increasingly preloaded in the wrong direction and the device would eventually either break down from destroying the balancing spring 16 or stall due to insufficient motor torque.

Figure 4C:
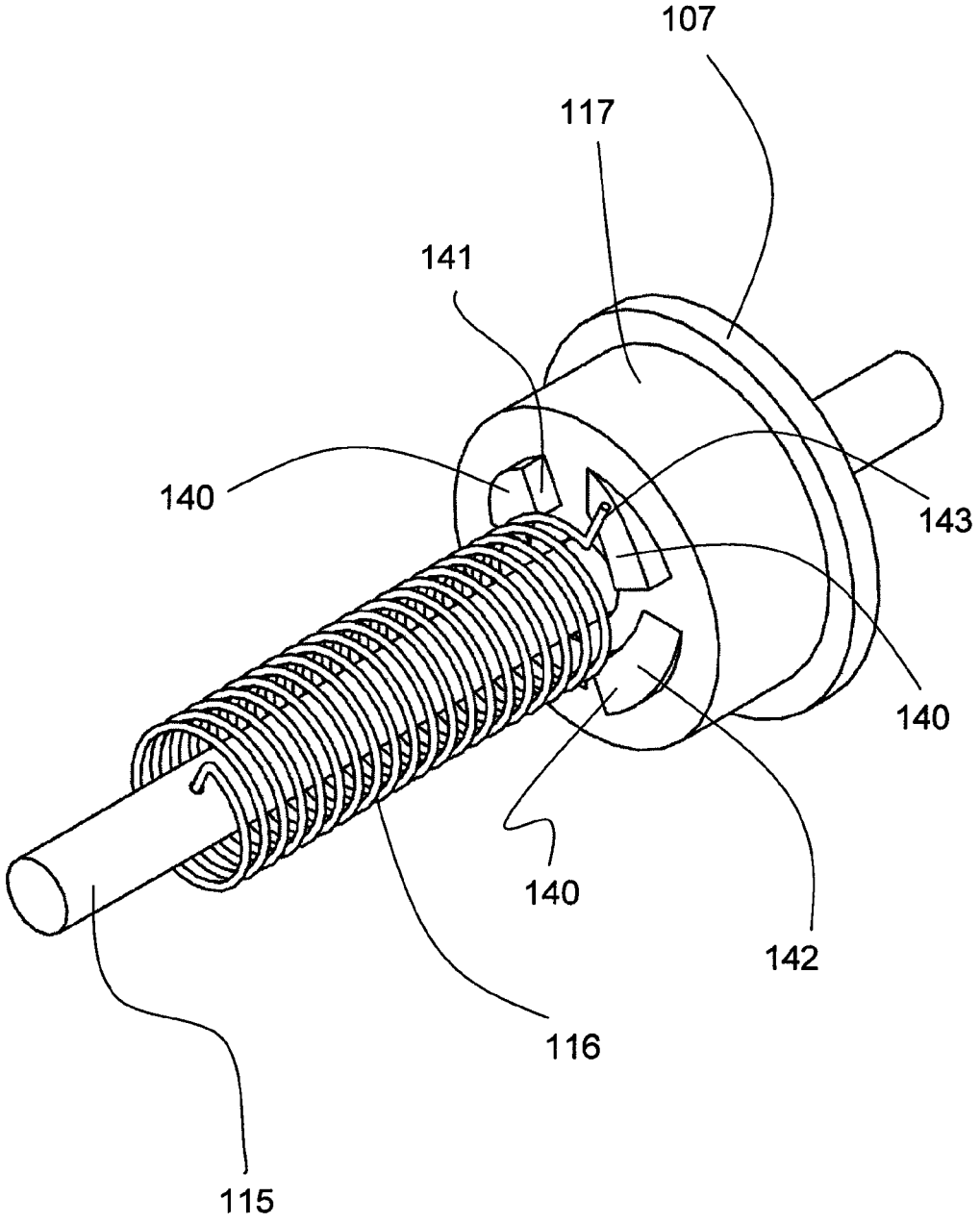
FIG. 4C shows a perspective view of an alternative embodiment of a freewheeling clutch 117.

In FIG. 4C an alternative design of a freewheeling clutch 117 is shown. In this connection it should be pointed out that the arrangement shown in FIG. 4C is reversed compared to the arrangement shown in FIG. 4. Thus, the freewheeling clutch 117 is integrated with the end cover 107 and one end of the balancing spring 116 is in engagement with said freewheeling clutch 117. The other end of the balancing spring 116 is fixedly connected to the journal 115 at a distance from the end cover 107 that generally corresponds to the length of the balancing spring 116. The freewheeling clutch 117 comprises a number of bosses 140 distributed around the journal 115. The bosses 140 comprise an end surface 141 and a sloping surface 142 that extends from the end surface 141 to the inner surface of the end cover 107. As the posters are unwound from the drum the balancing spring 116 will abut against the end surface 141 of the bosses 140 of the end cover 107 and thereby taking load, contributing a lifting force countering some or all of the weight of the posters. Then as the posters are wound up on the drum this abutment will still be in effect and the balancing spring 116 will continue to provide a lifting force. When the posters are once again fully wound up the balancing spring 116 will reach an unloaded state. Continuing in this winding up direction there are however no bosses to obstruct the movement of the balancing spring 116. Hence during any further movement in the winding up direction the balancing spring 116 will be free to slide on the sloping surfaces 142 of the bosses 140 and no preloading of the balancing spring 116 will be effected.

In order to accomplish the proper function of the device according to the preferred embodiment described earlier we may define the degrees of freedom of the internal parts as follows.

- The end covers 6 and 7 are provided freely rotatable with reference to journal 15 and motor holding bar 10 allowing the integration of ball bearings 8, 9 for lower friction or simply relying on sleeve bearings.
- The end covers 6 and 7 as well as the driving disc 14 are all fixed connected to the drum 1. The motor axis 12 is also fixed connected to the drum 1 via the driving disc 14.
- The motor 11 is fixed connected to the first end holding means 2 via the motor holding bar 10 to which also the controller unit 13 may be attached.
- The journal 15 and motor holding bar 10 are fixed connected to the first and second end holding means 2 and 3 respectively.
- The end holding means 2 and 3 need with reference to each other to allow no more than a few degrees of rotational freedom. This can either be achieved by providing the device with a crossbar or relying on the mounting of the device, i.e. letting the wall, ceiling or other device support restrict the rotation of the end holding means 2 and 3.
- The balancing spring 16 is fixed connected to the end cover 7. The other end of the balancing spring 16 is via the freewheeling clutch 17 allowed free rotation around the axis of the journal 15 in only one direction.

The function of the magnet assembly will be described below.

Figure 9:
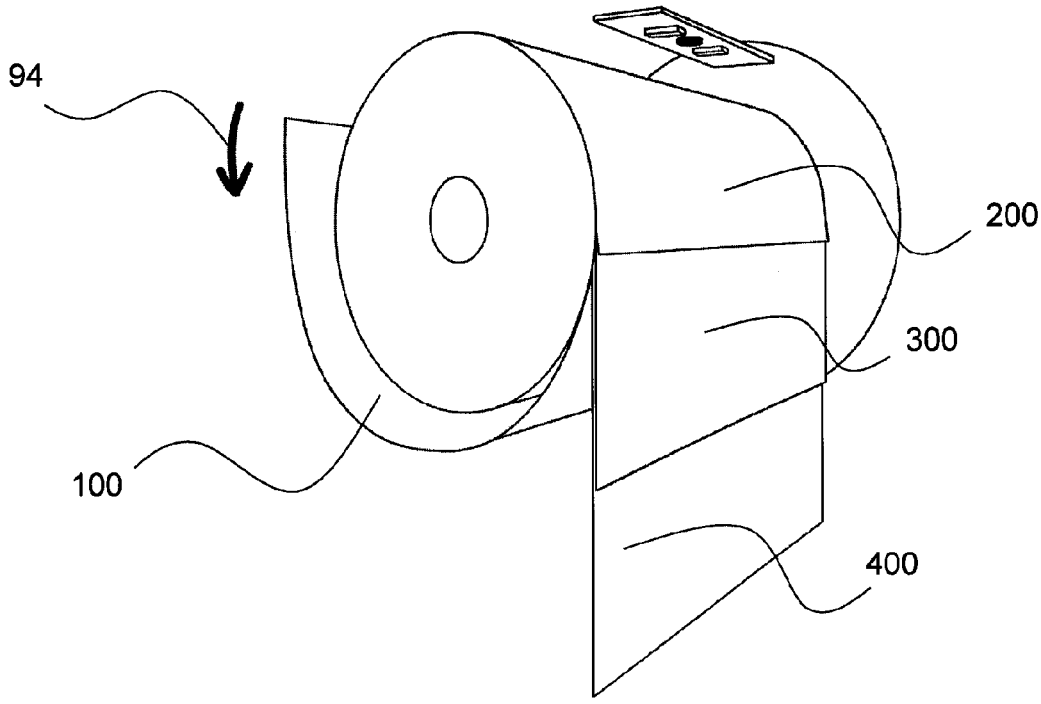
Figure 10:
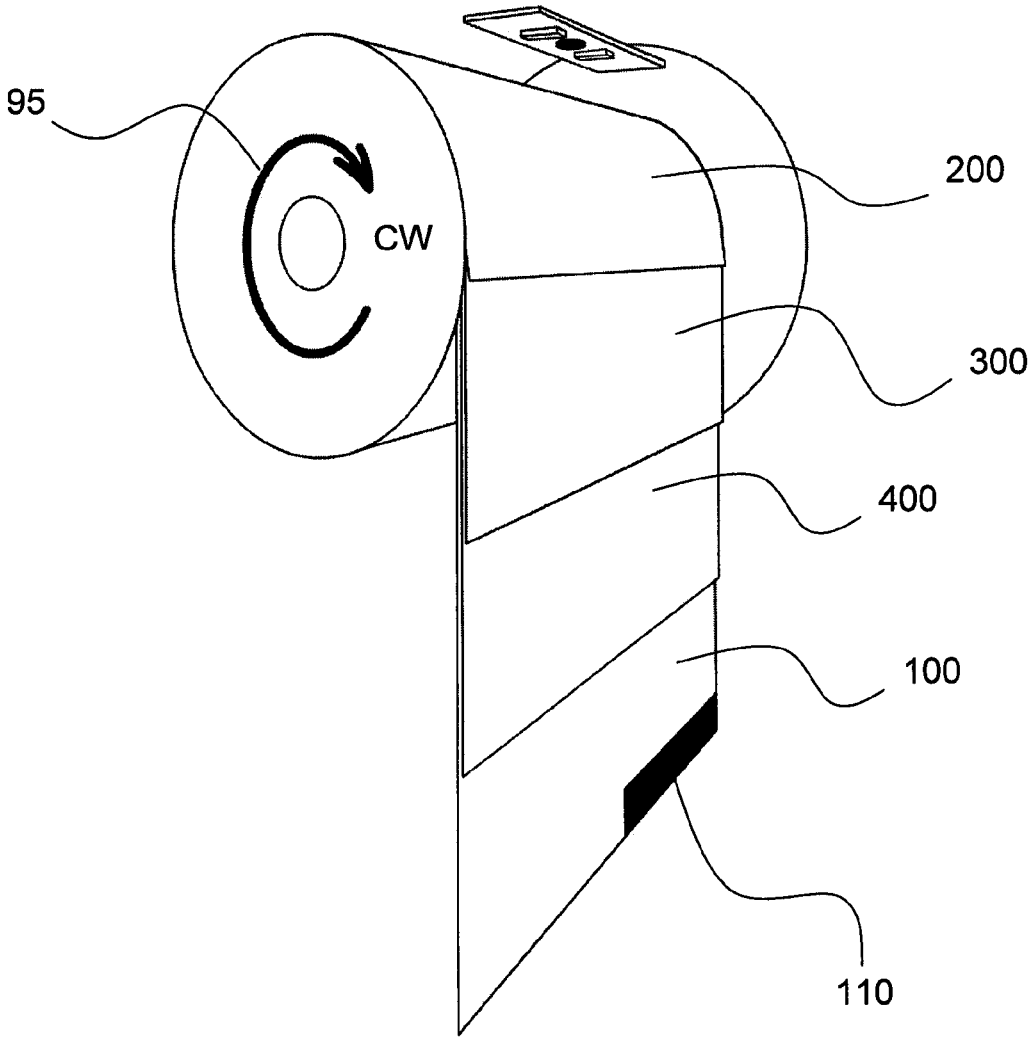

In order to successively change the posters 100-400 in a correct manner it is of utmost importance that the reversal of the rotation of the drum 1 occurs at the right position according to FIGS. 9 and 10. The posters 100-400 can be prearranged on the drum 1 for this to be accomplished and the controller unit 13 can be programmed to function according to these fixed positions. This does however require the user of the device to manually calibrate the device to the posters 100-400 and leaves the device completely unable to self-correct any shift from this calibration.

According to the function of the device, as the end of the poster to be exposed reaches the position on the drum 1 where it will fall over, the rotational direction of the drum 1 is reversed in order to expose this poster. It is necessary that this reversal occurs at a specific point in order to guarantee the function of the device. If the reversal is performed too early the next poster will not fall over and be exposed. If the reversal is too late there is a risk that the succeeding poster will also fall over, compromising the function of the device. The device therefore needs to be calibrated with the posters. The calibration signal can also be used by the controller unit 13 to determine whether the device is functioning properly and take care of any such detected problems should they arise.

One such means of calibration is depicted in FIGS. 3, 5, 6, 7, 8 and 10. An identification strip 110 is attached to one of the posters near or at the end of the poster. The device is fitted with a magnet 19 on the protruding girder 18. On this girder 18 close to the magnet 19 are means for identifying the end of the poster, referred to as identifying means 20. As the magnetically attractable identification strip 110 comes into proximity of the magnet 19 it is pulled towards the magnet and the accompanying identifying means 20 as depicted by arrow 91 in FIG. 6 whereby a signal is sent to the controller unit 13, indicating that one of the posters is near the top of the drum 1. There are several different techniques available for constructing the identifying means 20. They may for instance comprise an inductive sensor or one or more electric contact points, integrate an optic sensor device etc. but by bringing the end of the poster so close to the identifying means 20, precision and functionality is increased regardless of the method used for identification.

Figure 8:
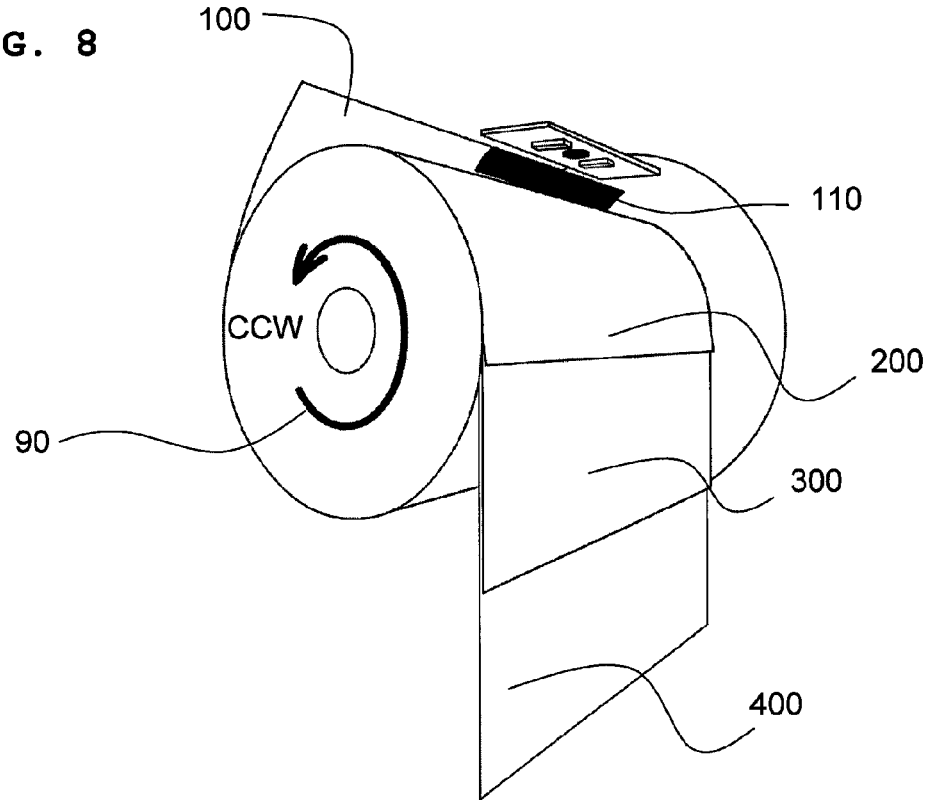

As the drum 1 is turning counterclockwise/CCW winding up the posters it will stretch the end of the poster 100 as the identification strip 110 is held back by the magnet 19. Eventually the poster 100 cannot be stretched any further and is released from the magnet 19 as depicted in FIG. 8. This point of release is of very high accuracy and is preferably the one used for calibrating the position of the posters.

Both of the signals mentioned above can be used as information for the controller unit 13 to determine the exact position of the posters. However, preferably the latter signal is used since the disengagement point of the identification strip 110 and the magnet 19 can easily achieve far greater accuracy than the engagement point. This is due to the very controlled nature of a stretched poster compared to the uncontrolled nature of an unstretched poster.

The device will in this way use the signal in order to determine the correct position at which to reverse the direction of the drum 1. Preferably this position is slightly after the identification strip 110 has disengaged the magnet 19 in order to ensure that the identification strip 110 is no longer influenced by the magnet and there is no chance of it being pulled back towards the magnet 19 as the rotation of the drum 1 is reversed.

For the next poster the position of reversal can easily be calculated by the controller unit 13 by adding ⅓, ¼ drum revolution etc. counterclockwise rotation according to the method described earlier. An identification strip 110 is therefore only necessary on one of the posters. It should however be understood that an identification strip can be attached to each and every of the posters e.g. in order to further enhance reliability of the device.

Although the most likely setup is having the identification strip 110 made of a passive material that will interact with the magnetic field of a magnet 19 it is also possible to make an identification strip 110 that is permanently magnetic whereby the magnet 19 can be replaced with a magnetically attractable material, e.g. soft iron. It is also possible to make the entire fabric of a poster or a part of it magnetic by use of special thread or printing ink. Furthermore the magnetic field provided either by the magnet 19 or by the identification strip 110 can be produced by means of an electro magnet having the benefit of being possible to turn on and off.

The advantages given to the device by magnetically attracting the posters towards the identifying means 20 can be summarized as improving the cost-efficiency, accuracy and reliability of calibration. It also has a self-cleaning effect as the identification strip 110 is forced to slide across the surface of the girder 18 thereby keeping surfaces free from corrosion or dust.

A method for attaching the posters to the device will be described below.

Figure 11:
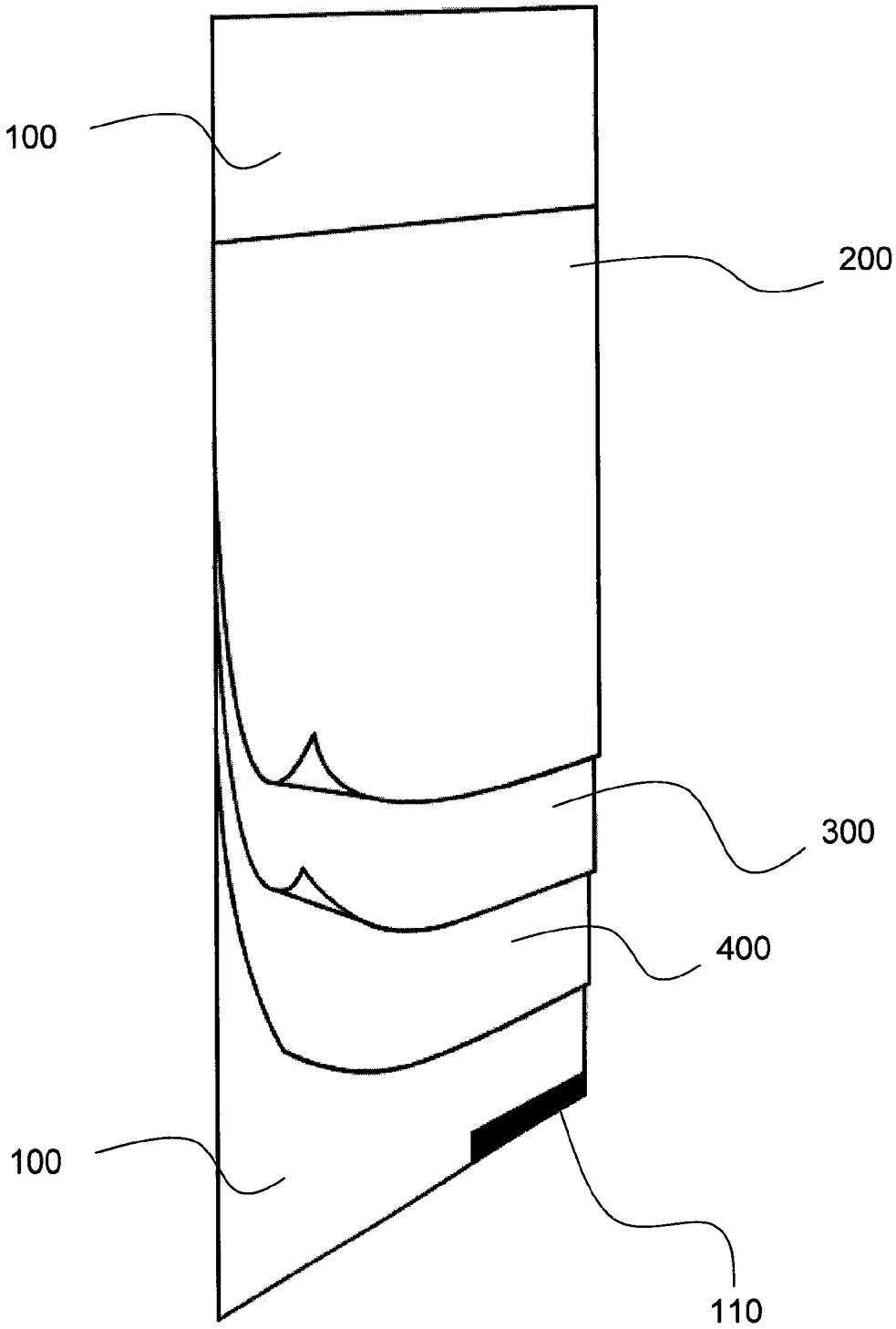
FIG. 11 shows in detail how the posters may be attached according to the present invention.

The posters 100-400 can be attached to the drum 1 in a variety of ways. In one preferred embodiment of the present invention the posters 100-400 are attached to each other as a separate package as depicted in FIG. 11 before being fixed to the drum 1. The first poster 100 being the carrier for the other posters needs to be a certain amount longer than the other posters in order to achieve proper exposure. The other posters are then attached to this carrier poster 100 at certain distances determined by the diameter of the drum 1 and the total number of posters.

Preferably, the posters are attached at the same mutual distance around the drum 1 in order to make it easier to program the controller unit 13 and also enhance the changing of the posters. However, it is also possible to provide the posters at different mutual distances to each other. The posters themselves might also be provided, if necessary, with weights such that the posters always appear in a stretched state.

When using a single identification strip 110 it can be provided on any of the posters 100-400 in order to achieve calibration of the poster position. By placing it on the carrier poster 100 as depicted in FIG. 11 it can however fulfill yet another objective. When a user wishes to switch the set of posters 100-400 for another set of posters and the principle of a carrier poster 100 is applied it is necessary that the carrier poster 100 is the front-most poster being exposed. The particular carrier poster 100 can be sorted out by the device given that the identification strip 110 is attached to said poster 100. During calibration as the identification strip 110 is recognized by the device and the poster 100 subsequently is changed to being the front-most poster the user can easily stop the device and efficiently make the desired switch of poster sets.

It should be understood that the design of the device can differ from the schematic view of FIG. 1. The drum 1 may for instance be made very narrow or even solid forcing the motor and balancing spring mechanisms to be outside the drum 1. It is however believed to be very advantageous both in a practical, economical and design sense to use the drum 1 as a housing for motor, balancing mechanisms, controller units etc. The balancing spring 16 and freewheeling clutch 17 as well as identifying means 20 and the identification strip 110 can be physically realized in a number of ways but in order to be utilized properly by the device they need to interact with each other in the ways described earlier. It shall be understood that even if the invention has been described with reference to preferred embodiments the invention is not limited thereto. Features from one embodiment may for example be used together with other embodiments. Thus, the features described above may be combined in any desired combination. There are many embodiments and variations that are within the scope of the invention, which are best defined by the accompanying claims.

FEASIBLE MODIFICATIONS OF THE INVENTION

In the embodiment described above the girder 18 is provided with one magnet 19. However, within the scope of the present invention it is feasible to have more than one magnet.

The invention claimed is:

1. Device for successively changing elongated flexible objects (100-400) from an active viewable position to a non-active, non-viewable position, said device comprising:

a rotatable drum (1) to which the flexible objects (100-400) are attached, a motor (11) arranged for driving the rotatable drum (1) in two opposing rotational directions comprising a first direction where the flexible objects (100-400) are unwound from the drum (1) and a second direction where the flexible objects (100-400) are wound up on the drum (1), a controller unit (13) for controlling the rotational speed and direction of the motor (11), a balancing spring (16; 116), and a freewheeling clutch (17; 117) mechanism operatively connected to the balancing spring in such a way that i) when the drum (1) is being rotated in the first direction where the flexible objects (100-400) are unwound from the drum (1), the freewheeling clutch (17; 117) engages with the balancing spring (16; 116) forcing the balancing spring (16; 116) to take increasing load, and ii) when the drum (1) is being rotated a first amount in the second direction where the flexible objects (100-400) are wound up on the drum (1), the balancing spring (16; 116) assists in rotating the drum (1) until the balancing spring (16; 116) has no inherent load, and when the rotation of the drum (1) in the second direction proceeds further beyond the first amount in the second direction where the balancing spring (16; 116) has no inherent load, no preloading of the balancing spring (16; 116) occurs.

2. Device according to claim 1, wherein the freewheeling clutch (17) is arranged at a end of the balancing spring (16) that is remote from an end cover (7) of the drum (1).

3. Device according to claim 2, further comprising:

an identification element (20) that determines a position of the flexible elongated objects (100-400) with respect to the drum, and a magnetically attractable element (110) attached to at least one the flexible elongated objects (100-400), and that causes the at least one of the flexible elongated objects (100-400) to be attracted toward the identification element (20) in order to improve interaction with the identification element (20).

4. Device according to claim 2, wherein the motor (11) is located inside the drum (1).

5. Device according to claim 1, wherein the freewheeling clutch (117) is arranged at an end of the balancing spring (116) that is adjacent to an end cover (107) of the drum (1).

6. Device according to claim 5, further comprising:

an identification element (20) that determines a position of the flexible elongated objects (100-400) with respect to the drum, and a magnetically attractable element (110) attached to at least one the flexible elongated objects (100-400), and that causes the at least one of the flexible elongated objects (100-400) to be attracted toward the identification element (20) in order to improve interaction with the identification element (20).

7. Device according to claim 6, wherein the motor (11) is located inside the drum (1).

8. Device according to claim 5, wherein the motor (11) is located inside the drum (1).

9. Device according to claim 1, further comprising:

an identification element (20) that determines a position of the flexible elongated objects (100-400) with respect to the drum, and a magnetically attractable element (110) that attracts at least one of the flexible elongated objects (100-400) toward the identification element (20) in order to improve interaction with the identification element (20).

10. Device according to claim 9, wherein the identification element (20) comprises a magnet (19).

11. Device according to claim 10, wherein the motor (11) is located inside the drum (1).

12. Device according to claim 10, wherein, the drum (1) is carried between two end holding elements (2, 3), the magnet (19) is provided on a girder (18) that is attached to a first of the end holding elements (2), the magnetically attractable element (110) is provided on at least one of the flexible objects (100-400), and the identification element (20) is provided on the girder (18).

13. Device according to claim 12, wherein the motor (11) is located inside the drum (1).

14. Device according to claim 9, wherein the motor (11) is located inside the drum (1).

15. Device according to claim 1, wherein the motor (11) is located inside the drum (1).

16. Device according to claim 15, wherein an output shaft (12) of the motor (11) is drivingly connected to a driving disc (14) inside the drum (1), and the driving disc (14) is rigidly connected to the drum (1).

* * * * *